US006422619B1

(12) United States Patent
Arabia, Jr. et al.

(10) Patent No.: US 6,422,619 B1
(45) Date of Patent: Jul. 23, 2002

(54) DOOR LATCH ASSEMBLY WITH INTEGRALLY MOLDED, FLEXIBLE INTERIOR DOOR SEAL

(75) Inventors: Frank Joseph Arabia, Jr., Macomb; Brent J Williams, Bloomfield; Donald Michael Perkins, Troy, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 69 days.

(21) Appl. No.: 09/705,064

(22) Filed: Nov. 2, 2000

(51) Int. Cl.[7] ..... E05B 9/00

(52) U.S. Cl. ..... 292/337; 292/DIG. 2; 292/DIG. 51

(58) Field of Search ..... 292/1, 341.11, 292/341.12, 337, 346, DIG. 2, DIG. 51, DIG. 55, DIG. 57; 70/DIG. 56

(56) References Cited

U.S. PATENT DOCUMENTS 3,103,378 A * 9/1963 Ahlgren ..... 292/17
3,768,115 A * 10/1973 Hoffmann ..... 16/2.1
5,064,229 A * 11/1991 Hamada ..... 292/216
5,348,357 A * 9/1994 Konchan et al. ..... 292/216
5,606,771 A * 3/1997 Young ..... 292/341.12
5,918,918 A * 7/1999 Mosley

* cited by examiner

*Primary Examiner*—Gary Estremsky
(74) *Attorney, Agent, or Firm*—Patrick M. Griffin

(57) ABSTRACT

An automotive latch assembly (46) includes an integrally molded seal (54) surrounding three sides of a striker entry hole (52), formed from the same relatively inflexible material as the latch assembly housing (48). The seal (54) comprises a general C shape, including a first wall (56) and two second walls (58), each of which slopes outwardly from said housing (48) and each of which is joined to an adjacent wall (56,58) at an obtuse angle. Each juncture of adjacent walls (56,58) comprises a flex joint (60) that includes a concave fold that flattens out as said adjacent walls (56,58) tend to diverge from one another as they are bent downwardly. This allows the seal (54) as a whole to effectively flex.

3 Claims, 4 Drawing Sheets

DOOR LATCH ASSEMBLY WITH INTEGRALLY MOLDED, FLEXIBLE INTERIOR DOOR SEAL

TECHNICAL FIELD

This invention relates to vehicle door latches in general, and specifically to a door latch assembly in which an effectively flexible interior door seal can be integrally molded to and with the relatively rigid plastic housing of the assembly itself.

BACKGROUND OF THE INVENTION

Vehicle doors are latched when the fork bolt of a latch assembly mounted inside the hollow interior of a swinging door engages a stationary striker on the vehicle body door pillar. The latch assembly fork bolt receives the striker through a hole in the door structure, a hole that opens through the corner juncture of the door inner panel and the door side panel. The latch assembly is mounted by machine screws that run through the door side panel and into threaded bushings in the latch assembly housing. Some clearance is needed between the interior surface of the door inner panel the latch housing to assure proper mounting. A designed or nominal tight contact between the latch housing and the interior surface of the door inner panel could, with expected tolerance variations, potentially jeopardize proper alignment between the mounting screws in the door side panel and the latch housing bushings. This necessary clearance presents a potential water or outside air entry path from the door's striker entry hole into the hollow door's interior. It is, therefore, customary to seal around the striker entry hole with a seal on the latch housing.

The typical seal is generally U or C shaped, consisting of rubber, foam or other elastic seal material, and is glued or otherwise attached to the latch housing. The seal is compressed around three sides of the door's striker entry hole as the latch housing is mounted inside the door. Since the door latch assembly is made up primarily of metal and rigid molded plastic pieces, it is not immediately obvious how a suitably flexible, three sided seal could be integrally formed to or with any part of the latch housing itself, which is why separate seals have been used. These separate seals, besides the additional cost and assembly steps required, are subject to damage and dislodging inside the door as the latch housing is mounted.

SUMMARY OF THE INVENTION

The subject invention provides a novel design for a seal that can be integrally molded integrally to the latch assembly, formed from the same relatively rigid plastic material as the latch assembly housing itself.

In the embodiment disclosed, the integrally formed seal comprises three generally planar walls, arrayed in a general C shape around three sides of the striker hole in the latch housing, which generally aligns with the striker hole in the door. When the latch assembly is installed within the door interior, therefore, the same three walls will be compressed against the interior surface of the door inner panel, thereby sealing around three sides of the striker hole in the door. The three seal walls are all molded with thin cross sections, and form an acute angle with the latch housing, sloping outwardly from a lower edge at the surface of the latch housing to a terminal edge.

If each of the three walls were structurally separate, each could be made individually flexible simply by being made sufficiently thin. However, in order to provide a complete seal, the three walls meet at integral corner junctures, and each wall would thereby significantly interfere with the flexing of its adjacent wall, but for a novel design feature. At the juncture of the walls, rather than a sharp, straight corner, a flex joint is provided, in the form of a concave, generally conical or funnel shaped depression, which widens and deepens moving toward the terminal edges of the adjacent seal walls. When the entire seal is compressed, which tends to flex the individual walls away from one another, and away from their corner juncture, the depression of the flex joint is able to flatten out, allowing the individual walls to flex together without retarding the flexing of adjacent walls. The entire seal is thereby rendered effectively flexible, in spite of being molded from a substantially rigid material.

DESCRIPTION OF THE PREFERRED EMBODIMENT

Figure 1:
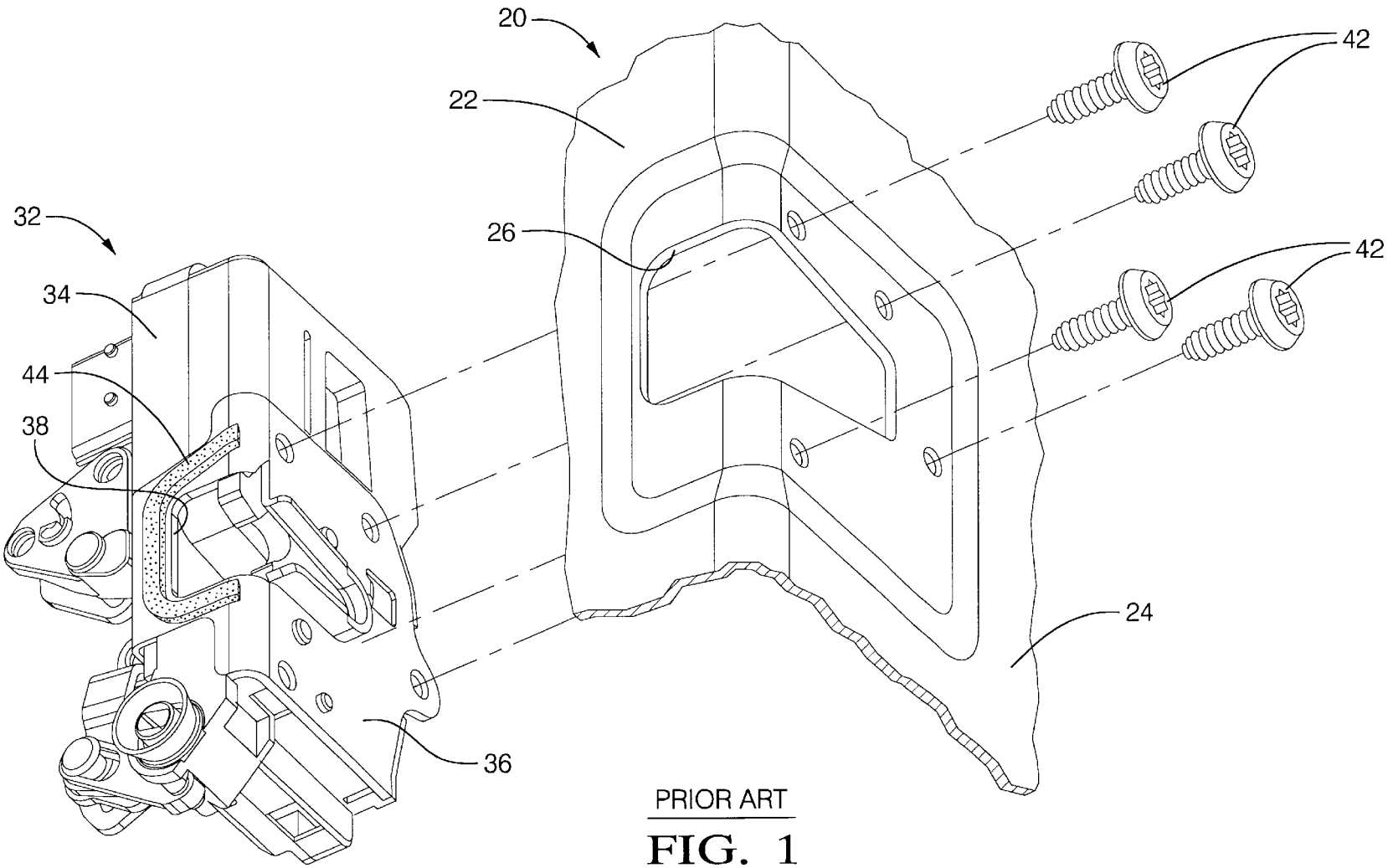
PRIOR ART FIG. 1
FIG. 1 is a perspective view of a vehicle door structure and latch assembly and housing with a conventional, separate, compression seal, shown disassembled.
Figure 2:
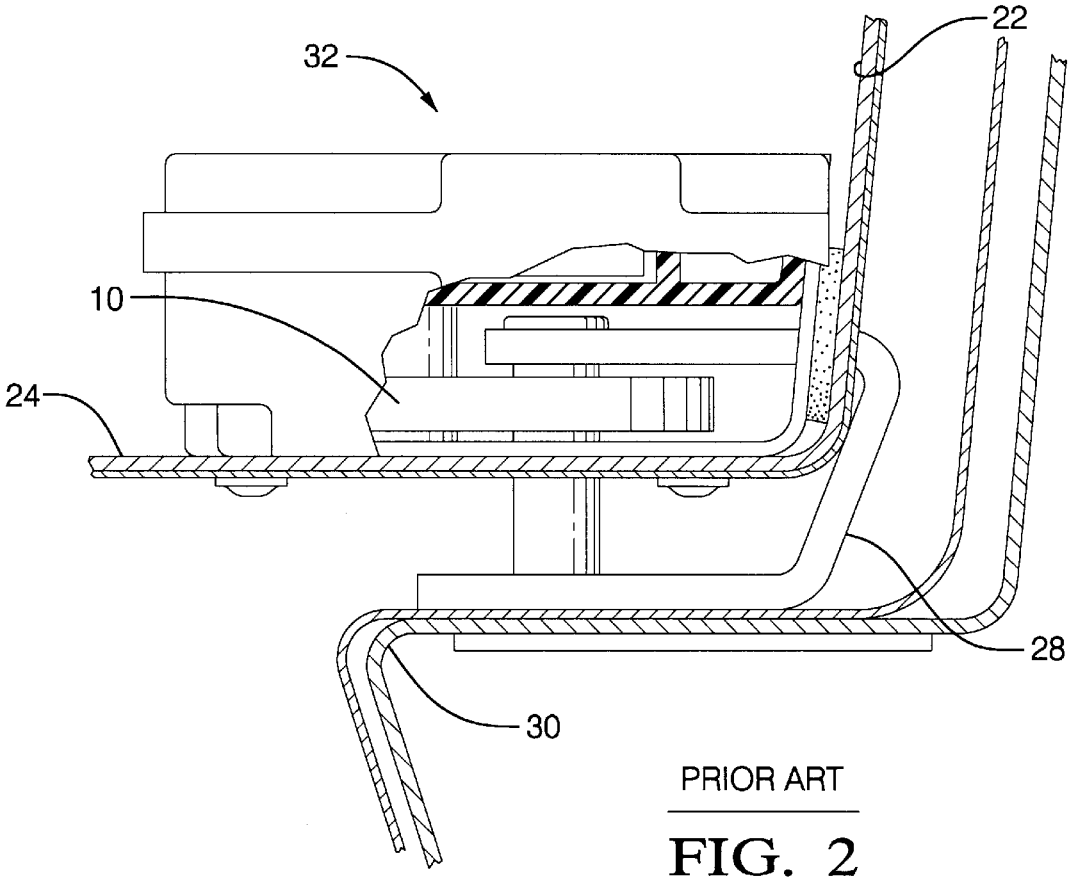
PRIOR ART FIG. 2
FIG. 2 is a cross section through a vehicle door pillar and the corner of the door structure, showing the prior art seal of FIG. 1 in place.

Referring first to FIGS. 1 and 2, a typical hollow vehicle door construction, indicated generally at 20, has an inner panel 22 that forms a generally 90 degree corner with a side panel 24. A striker entry hole 26 cut through both panels 22 and 24 receives a striker 28, which is attached to door pillar 30, when door 20 is closed, as seen in FIG. 2. A typical latch assembly, indicated generally at 32, has a housing 34, which is comprised of several rigid plastic and metal parts, including a metal face plate 36. A striker entry hole 38, sometimes called a "fishmouth slot", opens through the corner of housing 34 and face plate 36, and aligns with the door striker entry hole 26 when latch assembly 32 is mounted inside door 20. A forkbolt 40 within housing 34 is thereby able to capture striker 28 when door 20 is closed. The installation of latch assembly 32 is accomplished with machine screws 42, which pass through aligned holes in the door side panel 24 and the face plate 36, and ultimately into internal threaded bushings within housing 34, not illustrated.

Still referring to FIGS. 1 and 2, when latch assembly 32 is mounted within door 20, there is a snug conformance between the face plate 36 and the interior surface of door inner panel 22, but a significant, deliberate clearance "c" exists between the interior surface of door inner panel 22 and the latch housing 34. This clearance is needed to assure that there is no possibility of an "out of tolerance" binding contact between the latch housing 34 and the interior surface of door inner panel 22 could potentially prevent alignment of the screw holes in the door side panel 24 and the latch housing face plate 36. The clearance "c", while necessary, also creates a potential leak path for water or outside air from the striker entry hole 26 into the interior of door 20. Therefore, it has been customary to add a separate compression seal 44, surrounding three sides of the striker entry hole 38 of housing 34. The seal material is generally foam, rubber or other elastic material, and it is glued to housing 34 and carried by it. When housing 34 is in place, seal 44 will be compressed, within the clearance "c", against the interior surface of door inner panel 22, blocking the otherwise possible leak path. An extra part like seal 44 represents an inevitable extra cost in material and assembly steps, and is also subject to being dislodged or damaged during assembly, given its relatively fragile material. However, the materials from which housing 34 is typically made, metal and rigid plastics, are not conducive to providing an integral, but compressible seal.

Figure 3:
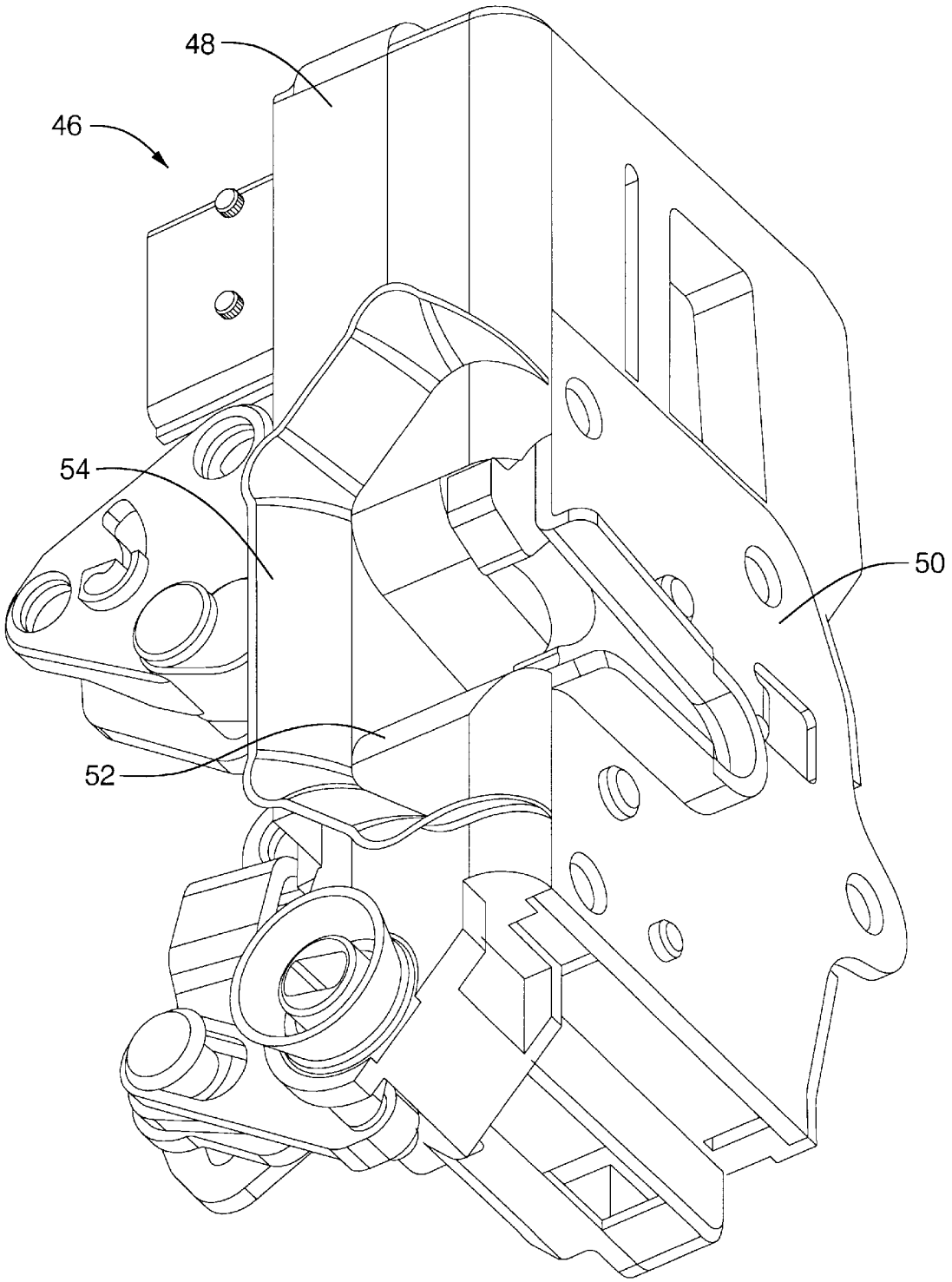
FIG. 3 is a perspective of a latch assembly and housing with the integrally molded seal of the invention.
Figure 6:
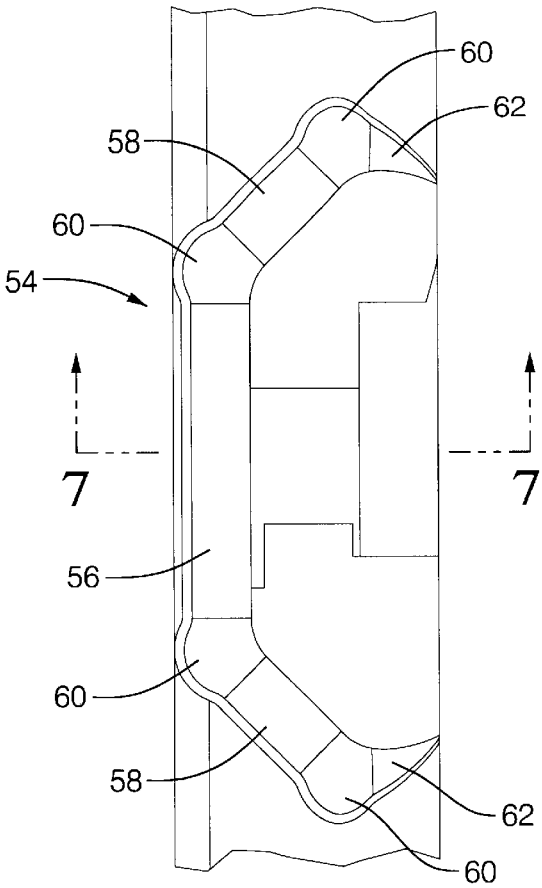
FIG. 6 is a plan view showing the integrally molded seal of the invention in a free state.

Referring next to FIG. 3, a latch assembly according to the invention, indicated generally at 46, is generally similar to prior art latch assembly 32, with a similar sized housing 48 and a metal face plate 50 that mounts to the same door 20, in the same way, with essentially identical screws 42. Unlike latch assembly 32's face plate 36, however, face plate 50 does not wrap around the side of housing 48, so that the striker entry hole 52 opens through a plastic portion of housing 48, not through a metal plate, as with the prior art striker hole 38 described above. The face plate 50 was deliberately configured in this way so as to create the potential for a novel compression seal design, indicated generally at 54, to be integrally molded to and with the plastic portion of housing 48. Details of the new seal design 54 are described next.

Figure 7:
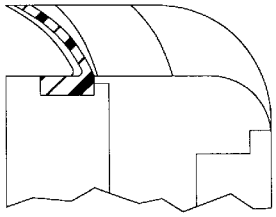
FIG. 7 is a sectional view taken along the line 7—7 of FIG. 6.
Figure 10:
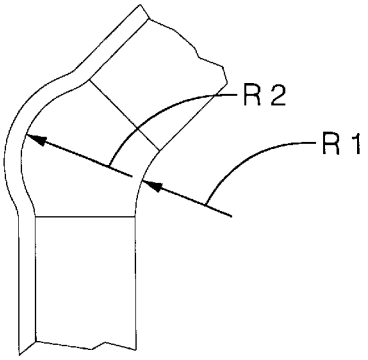
FIG. 10 is a perspective view of a single corner juncture of the seal of the invention in a free state.

Referring next to FIGS. 3, 6, 7, and 10, seal 54 and its various constituents, are shown in a free, uncompressed state. Seal 54 is molded integrally from the plastic material of housing 48, which is a thermoplastic material, such as acetal, which has a flexural modulus in the range of 350,000 to 432,000 psi. This is far higher than a conventional seal material, such as rubber or foam, compared to which acetal would considered relatively rigid, and not particularly suitable as a compressive sealing material. Nonetheless, the particular design detailed below is effectively flexible. Seal 54 is generally C shaped, with three walls, a longer wall 56 and two shorter walls 58, which together border three sides of striker entry hole 52. Each wall 56 and 58 slopes outwardly, cantilever fashion, at an acute angle of approximately 45 degrees, from a lower edge integral to the housing 48 to a terminal edge, to a height H of approximately eight mm. Each wall 56 and 58 is relatively thin in cross section, approximately 0.6 mm as disclosed, and is substantially planar, although slightly curved with a shallow radius of approximately twenty mm, as best seen in FIG. 7. The three walls 56 and 58 meet at an interior angle of less than 180 degrees, specifically at an obtuse angle of approximately 145 degrees, forming two integral corner junctures, but these are not simple, sharp corners, such as those found in a picture frame. Instead, each corner juncture comprises a flex joint formed as a concave, generally conical or funnel shaped depression 60. This conical section, as best seen in FIG. 10, diverges from a first radius R1 of approximately 6 mm to a second radius R2 of approximately 6.3 mm, and from essentially zero depth at the lower edge to a greatest depth of approximately one mm, in a free, unflexed state. The thickness of the plastic material in the flex joint 60 is substantially equal to the thickness of the walls 58 or 56 themselves, so it is not a mere thinning out of the material to create extra flexibility in one locality. Rather, it is more in the nature of a concave step or fold, in which "extra" material is stored. In addition, in the embodiment disclosed, the end of each of the shorter walls 58 is anchored to the housing 48 by a short buttressing wall 62, which is connected thereto at an angle of approximately ninety degrees by the same shaped depression 60. Each buttressing wall 62 converges over a very short distance back into the surface of housing 48. The buttressing walls 62 serve both to strengthen the shorter walls 58, and also wrap down around the rounded corner of housing 48, as best seen in FIG. 3, so as to complete the sealing boundary around striker entry hole 52.

Figure 4:
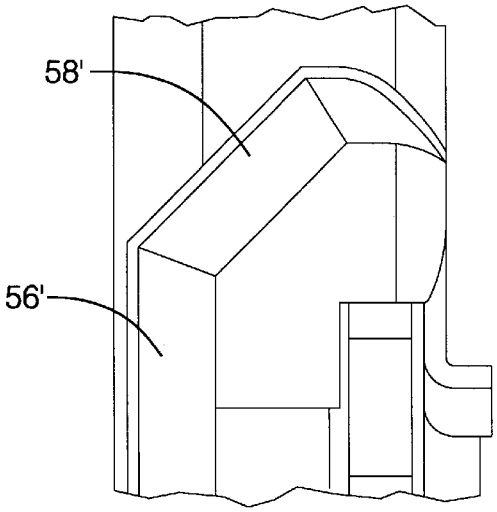
FIG. 4 is a perspective view of a pair of how a pair of walls molded with a straight line corner juncture would appear.
Figure 5:
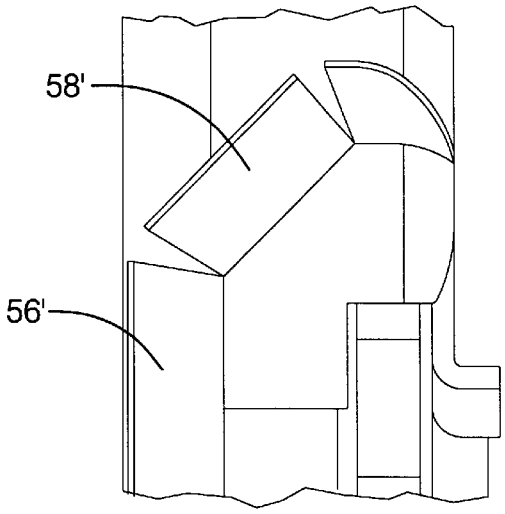
FIG. 5 is a view showing how a pair of walls molded as shown in FIG. 4 would react to attempted compression and flexing.

Referring next to FIGS. 4 and 5, the purpose of the flex joints 60 is illustrated by a schematic view of the obvious alternative manner in which the walls could be joined. If two similar walls, indicated at 56'- and 58', are simply joined at a sharp, straight line corner juncture, like the corner of a window frame or picture frame, their mutual flexibility is drastically impaired. This factor was unappreciated early in the design process, and samples similar to what is shown in FIGS. 4 and 5 were built and tested. What was found was that as the two walls 56 and 58 were pushed downwardly, thereby attempting to bend them down about their lower edges, they tended, by virtue of their included angle, to diverge or fall away from one another at the corner, as shown by the arrows. The overall result was a very stiff structure that resisted flexing overall and which, if forced, would either snap over center, and thereby lose contact with the surface against which it was supposed to seal, or split at the corner, and therefore was useless as a seal.

Figure 8:
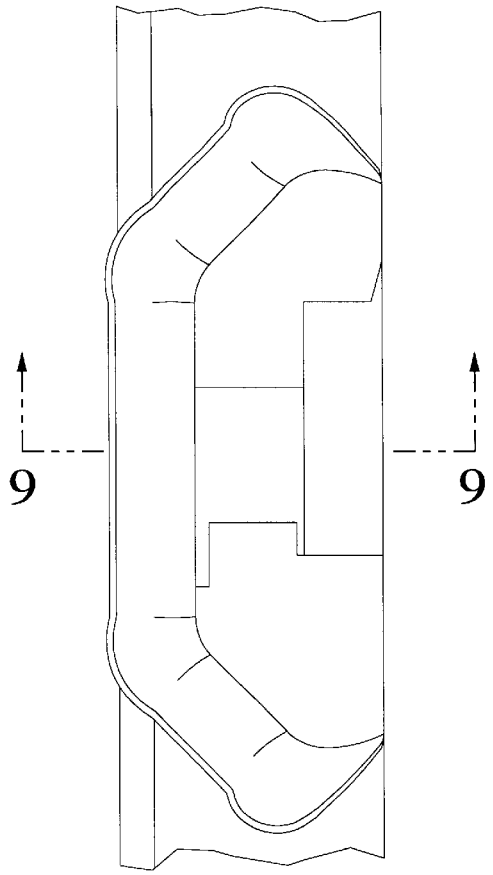
FIG. 8 is a plan view like FIG. 5, but showing the seal compressed and flexed.
Figure 9:
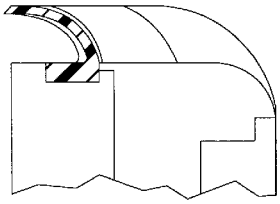
FIG. 9 is a sectional view taken along the line 9—9 of FIG. 8.
Figure 11:
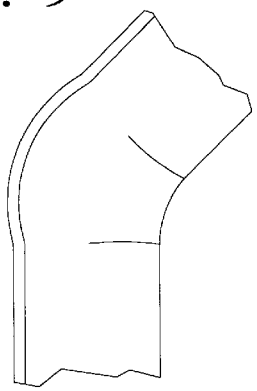
FIG. 11 is a view like FIG. 10, showing the corner juncture in its flexed, compressed state.

Referring next to FIGS. 8, 9 and 11, the operation of the novel design of the invention is illustrated. When the latch housing 48 is installed, the outer edges of the seal walls 56 and 58 are engaged and compressed by the interior surface of the door inner panel 22, within the clearance "c." Each wall 56 and 58 is thereby bent down and over slightly, as seen in FIG. 9, tending to move away from its adjacent wall. As this occurs, the concave flex joints 60 flatten out and essentially visually disappear, as best seen in FIGS. 8 and 11, at least in the area closest to the outer edges. The "extra" material reserved at the corners accommodates the tendency to diverge at the corners, reducing stress and preventing mutual resistance to flexing, or ultimate splitting. The overall effect is that the seal 54 as a whole is remarkably flexible, without breaking. The corner juncture depressions 60 provide "extra" material to allow for the kind of relative motion that a design like that illustrated in FIGS. 4 and 5 actually restricts and prevents. The diverging and deepening shape of the corner concavities 60 provides the potential for more relative flexing and motion where more is needed, that is, toward the outer edges of the walls 56 and 58. The net effect is that an integrally molded seal is provided which has a flexibility comparable to a standard, separate seal, but which is much more cost effective and which has essentially no possibility of becoming dislodged or damaged during installation.

Variations in the disclosed embodiment could be made. A potentially wide variation in plastic materials, sealing wall width, thickness and angle of slope could be made. So long as the walls were thin enough to be potentially flexible, similar depressions at the corner junctures would allow that potential flexibility to be realized, preventing mutual hindrance between the conjoined walls. More walls could be used to form the entire seal, providing a more complex polygonal, but still basically C shaped, seal surrounding the striker entry hole 52. The walls 56 ands 58 have to meet at a less than straight angle, in order to form a surrounding seal at all, but could meet at a sharper angle, potentially as small as ninety degrees or even less, rather than the shallower 145 degrees shown, creating a more squared off C shape surrounding the striker hole 52. This would be a simpler shape to mold, in fact, but the sharper the angle of juncture, the greater the degree to which the walls tend to diverge from that juncture as they are bent down and the greater the stress on the juncture. The actual shape of the flex joints at the corner junctures could vary somewhat. For example, the cross sectional shape could be more V shaped than funnel shaped, that is, sharper, rather than rounded, which would still provide a fold of extra material in reserve, which would flatten out to accommodate the tendency of the corner juncture to otherwise split apart. However, the more rounded, funnel shaped flex joints would create less of a stress riser at the corners. Therefore, it will be understood that it is not intended to limit the invention to the embodiment disclosed.

What is claimed is:

1. An automotive latch assembly (46) having a striker entry hole (52) formed through a housing (48) of relatively rigid plastic material, characterized in that a flexible seal (54) surrounding said striker entry hole (52) is integrally molded to and with said housing (48), said seal comprising a general C shape, including a first wall (56) and two second walls (58), each of which slopes outwardly from said housing (48) and each of which is joined to an adjacent wall (56,58) at a less than straight angle, and further characterized in that each juncture of adjacent walls (56,58) comprises a flex joint (60) that includes a concave fold that flattens out as said adjacent walls (56,58) tend to diverge from one another as they are bent downwardly, thereby allowing the seal (54) as a whole to effectively flex.

2. An automotive latch assembly (46) according to claim 1, further characterized in that said seal walls (56,58) form an obtuse angle.

3. An automotive latch assembly (46) according to claim 1, further characterized in that said flex joint (60) forms a generally conical depression.

* * * * *